US008501085B2

(12) United States Patent
Schlienger et al.

(10) Patent No.: US 8,501,085 B2
(45) Date of Patent: Aug. 6, 2013

(54) SYSTEM, METHOD, AND APPARATUS FOR POURING CASTING MATERIAL IN AN INVESTMENT CAST

(75) Inventors: Max Eric Schlienger, Napa, CA (US); John Sylvester Torpey, Ashbourne (GB); Paul Anthony Withey, Derby (GB)

(73) Assignee: Rolls Royce Corporation, Indianapolis, IN (US)

( * ) Notice: Subject to any disclaimer, the term of this patent is extended or adjusted under 35 U.S.C. 154(b) by 37 days.

(21) Appl. No.: 12/853,173

(22) Filed: Aug. 9, 2010

(65) Prior Publication Data

US 2011/0057364 A1 Mar. 10, 2011

Related U.S. Application Data

(60) Provisional application No. 61/232,458, filed on Aug. 9, 2009.

(51) Int. Cl.
*C22B 21/00* (2006.01)

(52) U.S. Cl.
USPC ..... 266/236; 266/275; 432/263

(58) Field of Classification Search
USPC ..... 266/236, 275; 222/598; 373/83; 432/263
See application file for complete search history.

(56) References Cited

U.S. PATENT DOCUMENTS

| | | | |
|---|---|---|---|
| 27,598 | A | 3/1860 | Keagy |
| 37,104 | A | 12/1862 | Maydole |
| 460,575 | A | 10/1891 | Grace |
| 1,773,799 | A | 8/1930 | Tornberg |
| 2,223,062 | A | 11/1940 | Edgar, Jr. |
| 2,836,866 | A | 6/1958 | McMillin |
| 2,863,189 | A | 12/1958 | Beck |
| 2,891,291 | A | 6/1959 | Schnacke |
| 2,957,936 | A | 10/1960 | Bugge |
| 3,310,851 | A | 3/1967 | Stiteler |
| 3,395,840 | A | 8/1968 | Gardner |
| 3,415,427 | A | 12/1968 | Sharp |
| 3,421,667 | A | 1/1969 | Stiteler |
| 3,435,882 | A | 4/1969 | Falk |
| 3,550,924 | A | 12/1970 | Grosko |
| 3,574,341 | A | 4/1971 | Fehling et al. |
| 3,651,825 | A | 3/1972 | Sury |
| 3,651,998 | A | 3/1972 | Rocher |
| 3,735,906 | A | 5/1973 | Zettlemoyer et al. |
| 3,785,540 | A | 1/1974 | Donnithorne et al. |
| 3,802,683 | A | 4/1974 | Lee et al. |
| 3,848,072 | A | 11/1974 | Dershem et al. |

(Continued)

OTHER PUBLICATIONS

International Search Report and Written Opinion, PCT/US2010/044909, Nov. 17, 2010, Rolls-Royce Corporation.

*Primary Examiner* — Scott Kastler
(74) *Attorney, Agent, or Firm* — Krieg Devault, LLP

(57) ABSTRACT

An apparatus for bottom pouring into an investment cast includes a container that holds a melted casting material, where the container moves from a first container position to a second container position. In the first container position, holes on a stationary nozzle are not exposed to the interior of the container, and the melted casting material remains in the container. In the second container position, holes on the stationary nozzle are exposed to the interior of the container, and the melted casting material flows out the bottom of the container through the stationary nozzle. A temperature detection device determines the temperature of the melted casting material, and a heating device heats the melted casting material to a specified temperature.

20 Claims, 3 Drawing Sheets

U.S. PATENT DOCUMENTS

| | | | | |
|---|---|---|---|---|
| 3,880,265 | A | | 4/1975 | Elmer |
| 3,946,907 | A | | 3/1976 | Berve |
| 4,131,219 | A | | 12/1978 | Hind et al. |
| 4,176,769 | A | | 12/1979 | Cudby et al. |
| 4,202,473 | A | | 5/1980 | Szadkowski et al. |
| 4,298,147 | A | | 11/1981 | Honda et al. |
| 4,310,084 | A | | 1/1982 | Nonnenmann |
| 4,310,085 | A | | 1/1982 | LaFlame |
| 4,312,433 | A | | 1/1982 | Bopp |
| 4,346,797 | A | | 8/1982 | Bopp |
| 4,354,831 | A | * | 10/1982 | Shinkawa et al. ..... 432/263 |
| 4,403,757 | A | | 9/1983 | Shepherd |
| 4,421,257 | A | | 12/1983 | Thrower |
| 4,456,588 | A | | 6/1984 | Shimizu |
| 4,458,798 | A | | 7/1984 | Bopp |
| 4,502,580 | A | | 3/1985 | Clancey |
| 4,543,981 | A | | 10/1985 | Bates et al. |
| 4,579,206 | A | | 4/1986 | Velderman et al. |
| 4,591,037 | A | | 5/1986 | Bopp |
| 4,630,666 | A | | 12/1986 | Wismann |
| 4,641,768 | A | | 2/1987 | Hill |
| 4,785,979 | A | | 11/1988 | Svoboda et al. |
| 4,795,066 | A | | 1/1989 | Worrell |
| 4,799,649 | A | | 1/1989 | King |
| 4,854,488 | A | | 8/1989 | Trenkle et al. |
| 4,874,072 | A | | 10/1989 | Mohan et al. |
| 4,919,191 | A | | 4/1990 | Brodersen |
| 4,944,497 | A | | 7/1990 | Grabner et al. |
| 4,971,294 | A | | 11/1990 | Sherrill |
| 5,154,875 | A | | 10/1992 | Luchs |
| 5,164,097 | A | | 11/1992 | Wang et al. |
| 5,312,090 | A | | 5/1994 | Seaton et al. |
| 5,330,162 | A | | 7/1994 | Nakashima et al. |
| 5,916,473 | A | | 6/1999 | Kerin |
| 6,896,030 | B2 | | 5/2005 | Soderstrom et al. |
| 2002/0104638 | A1 | | 8/2002 | Tabatabaei et al. |

* cited by examiner

SYSTEM, METHOD, AND APPARATUS FOR POURING CASTING MATERIAL IN AN INVESTMENT CAST

CROSS REFERENCE TO RELATED APPLICATIONS

The present application claims the benefit of U.S. Provisional Patent Application No. 61/232,458, filed Aug. 9, 2009, and is incorporated herein by reference.

BACKGROUND

The technical field generally relates to investment casting techniques and equipment. Investment castings involve pouring molten material from a crucible into a mold. Top-poured systems often have the drawbacks that they can be messy and difficult to control. Many bottom-poured systems known in the art are complex and/or suffer from reliability issues. Therefore, further technological developments are desirable in this area.

SUMMARY

One embodiment is a unique system for bottom-pouring molten material into a casting. Further embodiments, forms, objects, features, advantages, aspects, and benefits shall become apparent from the following description and drawings.

DESCRIPTION OF THE ILLUSTRATIVE EMBODIMENTS

Figure 1:
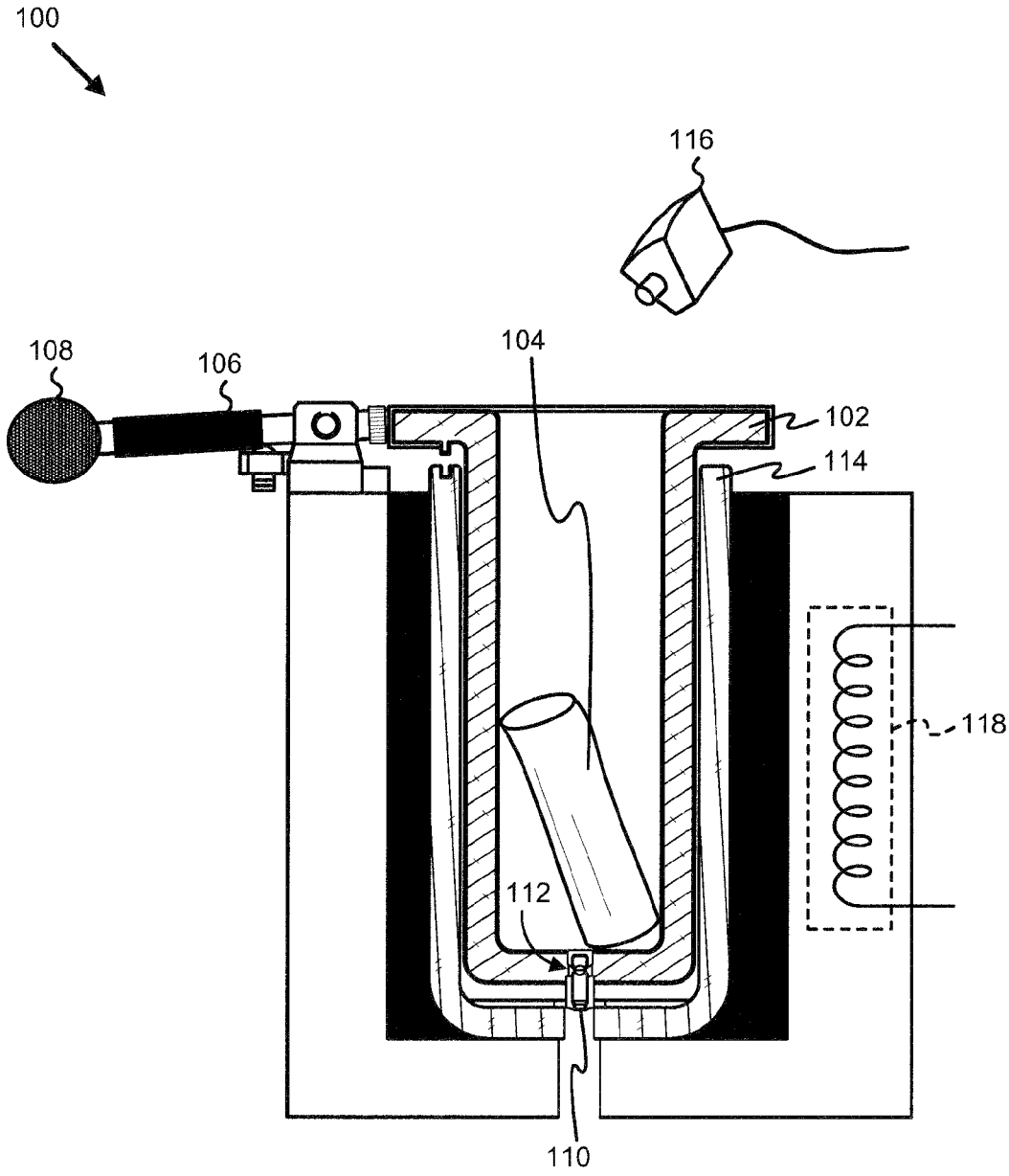
FIG. 1 is a schematic diagram of an investment casting system including a container in a first container position.

For purposes of promoting an understanding of the principles of the invention, reference will now be made to the embodiments illustrated in the drawings, and specific language will be used to describe the same. It will nonetheless be understood that no limitation of the scope of the invention is intended by the illustration and description of certain embodiments of the invention. In addition, any alternations and/or modifications of the illustrated and/or described embodiment(s) are contemplated as being within the scope of the present invention. Further, any other applications of the principles of the invention, as illustrated and/or described herein, as would normally occur to one skilled in the art to which the invention pertains, are contemplated as being within the scope of the present invention.

FIG. 1 is a schematic of an investment casting system 100 including a container 102 in a first container position. The system 100 includes a container 102 adapted to hold a melted casting material 204 (refer to description referencing FIG. 2). In the embodiment of FIG. 1, the casting material 104 is a solid charge of casting material, and the container 102 is further adapted for the melted casting material 204 to be melted in the container 102. The container 102 may be a crucible capable of holding a molten metal as the casting material 104. In certain embodiments, container 102 is a fiber crucible—e.g. a ceramic fiber. In certain embodiments, the container 102 moves vertically, for example sliding in a liner 114. In a further embodiment, the first container position is a high position, and a second container position is a low position.

The system 100 includes a biasing member 106 adapted to hold the container 102 in a first container position (or first crucible position) as illustrated in FIG. 1. The biasing member 106 illustrated in FIG. 1 includes a counterweight 108 to provide a biasing force that holds the container 102 in the first position. The biasing member 106 may be a spring or other biasing member understood in the art. In certain embodiments, the biasing member 106 is configured to apply a biasing force at least equal to the combined weight of the container 102 and casting material 104. In certain embodiments, for example where the container 102 slides at an angle less than vertical, the biasing force may be less than the combined weight of the container 102 and the casting material 104.

The system 100 includes a stationary nozzle 110 having a hole 112 (or holes) such that in the first container position, the casting material 104 remains in the container 102 after melting, and in a second container position (e.g. refer to the description referencing FIG. 2) the melted casting material 204 flows through the hole(s) 112. The hole(s) 112 may be of any shape, size, or configuration that allows acceptable flow rates of the melted casting material 204. The stationary nozzle 110 thereby releases the melted casting material 204 from the container 102 in response to the container 102 being in the second container position.

The container 102 is adapted to slidably receive the stationary nozzle 110. In one embodiment, the container 102 receives the stationary nozzle 110 at the bottom of the container 102. In the illustration of FIG. 1, the container 102 receives the stationary nozzle 110 by sliding over the nozzle 110 vertically, and the first container position is the high position while the second container position is the low position. In certain embodiments, the container 102 may slide at an angle to the vertical or even horizontally, and the first container position and second container positions may be oriented accordingly. In certain embodiments, the container 102 is a fiber crucible that slides vertically within a liner 114.

In certain embodiments, the system 100 further includes temperature detection to interpret a temperature of the melted casting material 204. Interpreting the temperature includes reading the temperature value from a temperature-based sensor (e.g. infrared, thermistor, or thermocouple), reading a value representative of temperature from a datalink or communication device, and/or inferring or calculating the temperature value from other parameters measured in the system. The detected temperature may be a direct temperature of the melted casting material 204, or an offset temperature correlated to the melted casting material 204 temperature. The temperature detection illustrated in FIG. 1 includes an infrared sensor 116.

The system 100 further includes a heating device 118 adapted to heat the melted casting material 204 to a specified temperature. The heating device 118 may include the same heat source that melts the casting material 104, but the heating device 118 may also be a different device. In the illustration of FIG. 1, the heating device 118 is an induction heater. The specified temperature is whatever temperature a practitioner determines the melted casting material 204 should be poured at, and is a temperature generally understood in the art based upon the specific material being poured, and the configuration of the casting mold including the geometry and heat transfer environment of the mold.

Figure 2:
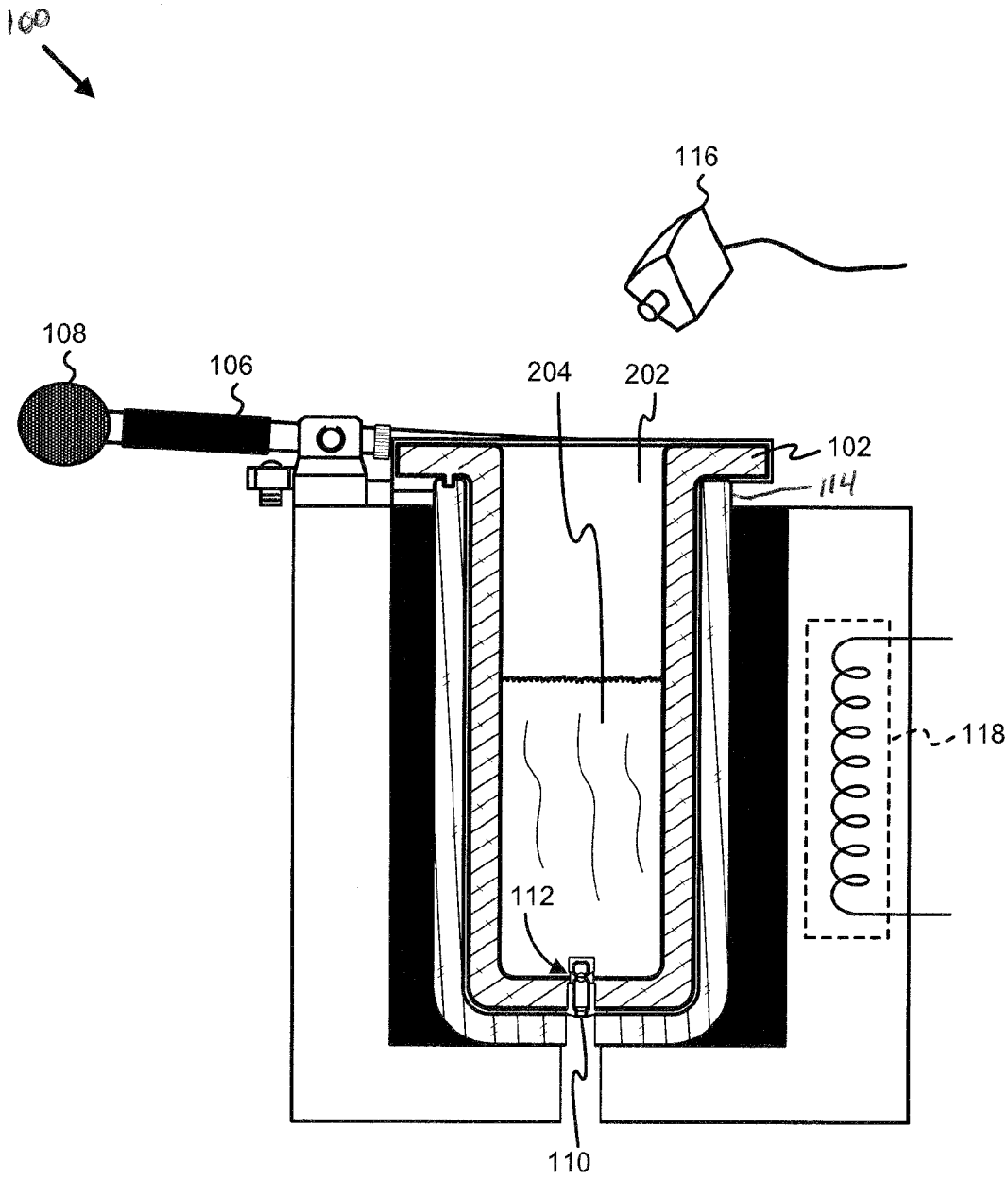
FIG. 2 is a schematic diagram of an investment casting system including a container in a second container position.

FIG. 2 is a schematic of an investment casting system 200 including a container 102 in a second container position (second crucible position where the container 102 is a crucible). In the embodiment illustrated in FIG. 2, the heating device 118 has heated the casting material 104 to create the melted casting material 204. A force is applied to overcome the biasing force from the biasing member 106 (the counterweight 106 is lifted in the example), such that the container 102 slides vertically to the second container position and receives the stationary nozzle 110. The hole(s) 112 are exposed to an interior 202 of the container 102 in the second position, pouring the melted casting material 204 from the container 102. In one embodiment, the container 102 is a crucible, and the stationary nozzle 112 is adapted to release the melted casting material 204 from the crucible in the second crucible position. The illustration of FIG. 2 is shown schematically at a theoretical moment before the melted casting material 204 pours through the hole(s) 112 and out of the system 200 into a mold (not shown). FIG. 2 does not illustrate the melted casting material 204 actually pouring from the container 102 to avoid obscuring aspects of the presented embodiment.

Figure 3:
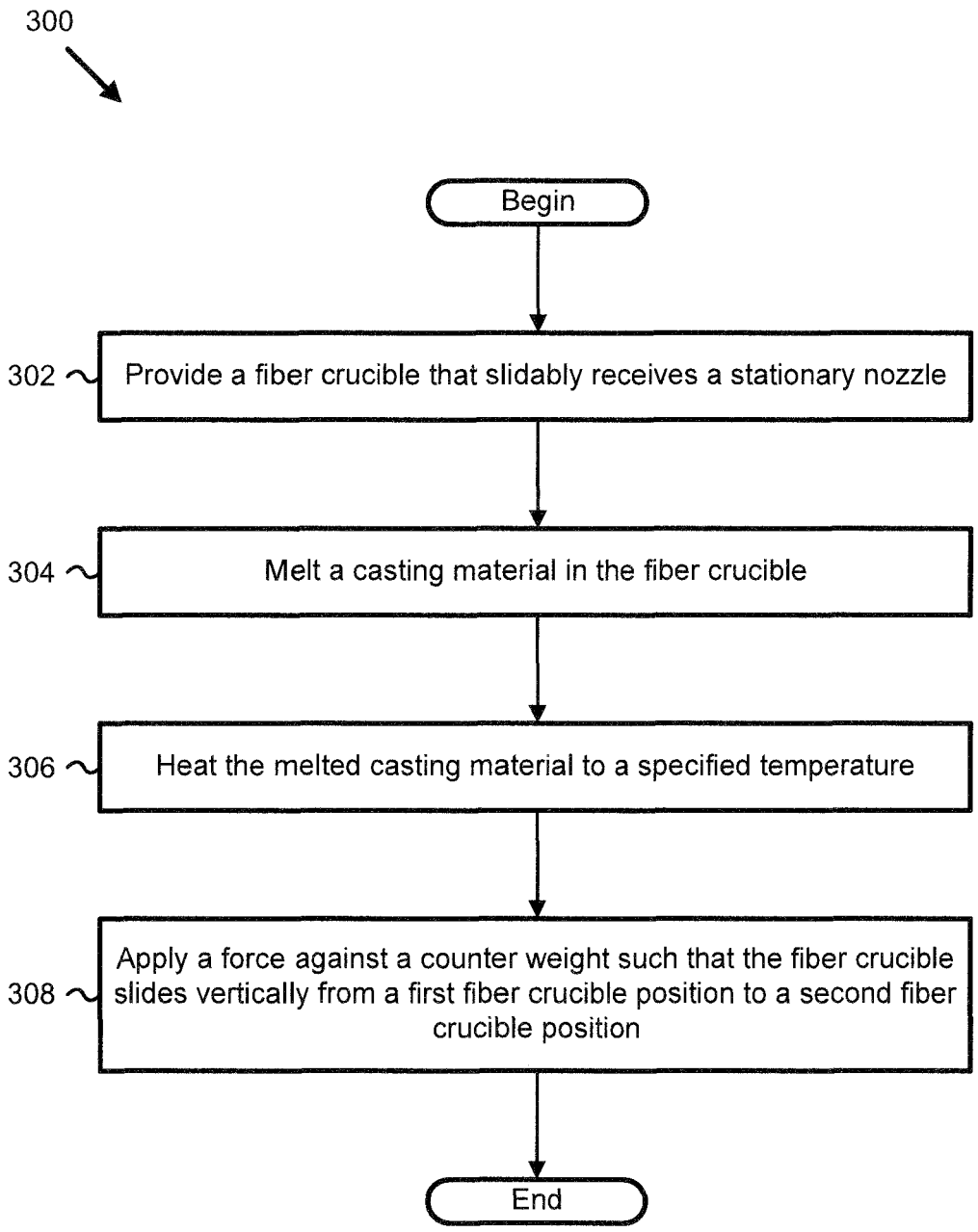
FIG. 3 is a schematic flow diagram of a procedure for bottom pouring for investment casting.

FIG. 3 is a schematic of an exemplary procedure 300 for bottom pouring in an investment casting system. The procedure 300 includes a an operation to provide 302 a container that slidably receives a stationary nozzle, where the container for the exemplary procedure is a fiber crucible. The procedure 300 further includes an operation 304 to melt a casting material in the container. In a further embodiment, the procedure 300 includes an operation 306 to heat the melted casting material 204 to a specified temperature. The procedure 300 further includes an operation 308 to apply a force against a biasing member, such that the container slides from a first container position to second container position. In the exemplary procedure 300, the biasing member is a counterweight.

Certain exemplary embodiments include a heating means. Non-limiting examples of a heating means are described. An exemplary heating means is an induction coil in proximity to the crucible that inductively heats metal within the crucible. Another exemplary heating means is a burner structured to provide heat to the crucible, heating material within the crucible. Another exemplary heating means is a heat transfer device structured to provide heat to the crucible conductively, convectionally, and/or by radiation, thereby heating material within the crucible.

Certain exemplary embodiments include a biasing means. Non-limiting examples of a biasing means are described. An exemplary biasing means is a counter-weight coupled to or included with a lever arm on a first side of a pivot point, with the crucible coupled to or included with the lever arm on a second side. Another exemplary biasing means includes a deformable metal structure that forces the crucible into a raised position, where the deformable metal structure includes a spring, dome, or partial dome.

Certain exemplary embodiments include a dispensing means. Non-limiting examples of a dispensing means are described. An exemplary dispensing means includes a nozzle positioned at the bottom of the crucible. Holes in the nozzle are exposed to the interior of the crucible in response to one of the crucible being lowered or the crucible being raised.

As is evident from the figures and text presented above, a variety of embodiments according to the present invention are contemplated. Certain exemplary embodiments include an apparatus having a container adapted to hold a melted casting material and further adapted to slidably receive a stationary nozzle. The stationary nozzle may be received at the bottom of the container. The apparatus further includes the stationary nozzle having a hole such that in a first container position the melted casting material remains in the container, and in a second container position the melted casting material flows through the hole. The apparatus further includes a biasing member that holds the container in the first container position.

In certain further embodiments, the container is a fiber crucible. In further exemplary embodiments, the melted casting material is a molten metal. In certain further embodiments, the container slides vertically, and the first container position is a high position and the second container position is a low position. In certain further embodiments, the biasing member holds the container in the first position with a biasing force at least equal the weight of the melted casting material. In certain embodiments, the biasing member may be a counterweight and/or a spring.

Certain exemplary embodiments include an apparatus having a container adapted to hold a melted casting material and to slidably receive a stationary nozzle. The apparatus further includes a biasing means that holds the container in a first container position with a biasing force. The apparatus further includes a dispensing means adapted to retain the melted casting material in the container in a first container position, and to pour the melted casting material from the container in a second container position. In certain further embodiments, the biasing means includes a spring or a counterweight. In certain further embodiments, the dispensing means includes a stationary nozzle with holes, wherein the holds are exposed to an interior of the container in the second position.

Certain exemplary embodiments include a system having a crucible adapted to accept a solid casting material, where the crucible slidably receives a stationary nozzle. The system further includes a heating means adapted to melt the solid casting material, and a biasing member adapted to hold the container in a first crucible position where the crucible retains the melted casting material in the first crucible position. The system further includes the stationary nozzle adapted to release the melted casting material from the crucible in a second position. In certain further embodiments, the system includes the crucible comprising a fiber crucible that slides vertically, where the crucible is disposed within a liner. In certain further embodiments, the system includes the biasing member comprising a counterweight. In certain further embodiments, the system includes a temperature detection means that interprets a temperature of the melted casting material, where the heating means is further adapted to heat the melted casting material to a specified temperature. In certain embodiments, the heating means includes an induction heater.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred, more preferred or exemplary utilized in the description above indicate that the feature so described may be more desirable or characteristic, nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An apparatus, comprising:

a container adapted to hold a melted casting material, the container having an opening structured to slidably receive a stationary nozzle therein, wherein the stationary nozzle having a hole such that in a first container position, the melted casting material remains in the container, and in a second container position the melted casting material flows through the hole; and a biasing member adapted to hold the container in the first container position;

wherein the first container position is a high position and the second container position is a low position.

2. The apparatus of claim 1, wherein the container comprises a fiber crucible.

3. The apparatus of claim 1, wherein the container comprises a ceramic crucible.

4. The apparatus of claim 1, wherein the melted casting material comprises a molten metal.

5. The apparatus of claim 1, wherein the container slides vertically.

6. The apparatus of claim 1, wherein the biasing member holds the container in the first position with a biasing force at least equal to a weight of the melted casting material.

7. The apparatus of claim 1, wherein the biasing member is a counterweight.

8. The apparatus of claim 1, wherein the nozzle is received at the bottom of the container.

9. The apparatus of claim 1, wherein the container is further adapted for the melted casting material to be melted in the container.

10. An apparatus, comprising:

a container adapted to hold a melted casting material, the container further adapted to slidably receive a stationary nozzle;

biasing means that holds the container in a first container position with a biasing force; and dispensing means adapted to retain the melted casting material in the container in the first container position, and further adapted to pour the melted casting material from the container in a second container position.

11. The apparatus of claim 10, wherein the biasing means comprises a member selected from the group consisting of a spring and a counterweight.

12. The apparatus of claim 10, wherein the dispensing means comprises a stationary nozzle with holes, wherein the holes are exposed to an interior of the container in the second container position.

13. A system, comprising:

a crucible adapted to accept a solid casting material, where the crucible slidably receives a stationary nozzle that includes a stationary nozzle surface oriented to be in contact with a melted casting material created from the solid casting material;

heating means adapted to melt the solid casting material to form the melted casting material;

biasing member adapted to hold the container in a first crucible position, wherein the crucible retains the melted casting material in the first crucible position and in which the melted casting material is in contact with the stationary nozzle surface; and wherein the stationary nozzle is adapted to release the melted casting material from the crucible in a second crucible position.

14. The system of claim 13, wherein the crucible comprises a fiber crucible that slides vertically, and wherein the crucible is disposed within a liner.

15. The system of claim 13, wherein the biasing member comprises a counterweight.

16. The system of claim 13, further comprising a temperature detector that interprets a temperature of the melted casting material, wherein the heating means is further adapted to heat the melted casting material to a specified temperature.

17. The system of claim 16, wherein the heating means comprises an induction heater.

18. The system of claim 16, wherein the heating means comprises a resistance heater.

19. The system of claim 16, wherein the heating means comprises a plasma heater.

20. The system of claim 16, wherein the heating means comprises an electron beam.

* * * * *